US005361555A

United States Patent [19]

Walker

[11] Patent Number: 5,361,555

[45] Date of Patent: Nov. 8, 1994

[54] ELECTROMAGNETIC PATCH FOR TANK REPAIR

[76] Inventor: Jack Walker, 4319 Bramers La., Louisville, Ky. 40216

[21] Appl. No.: 56,475

[22] Filed: May 3, 1993

[51] Int. Cl.[5] ..... E04G 23/02; E02D 37/00

[52] U.S. Cl. ..... 52/514; 220/230; 206/818; 52/DIG. 4

[58] Field of Search ..... 52/514, DIG. 4; 220/230, 582, 818; 206/582, 818

[56] References Cited

U.S. PATENT DOCUMENTS

| | | | |
|---|---|---|---|
| 2,403,083 | 7/1946 | Hull | 403/127 |
| 2,772,804 | 2/1956 | Byrnes | 220/230 |
| 2,781,939 | 2/1957 | Lockwood | 220/239 |
| 3,053,433 | 9/1962 | Wall | 206/818 |
| 3,951,378 | 4/1976 | Manor | 251/65 |

*Primary Examiner*—James L. Ridgill, Jr.
*Attorney, Agent, or Firm*—Scott R. Cox

[57] ABSTRACT

A device for patching chemical tanks or tank cars comprised of a housing, at least a pair of electromagnets, and a seal which is secured to a pressure system which is secured to the housing, wherein the pressure system permits the seal to be extended from the housing against the surface of a tank or tank car.

10 Claims, 2 Drawing Sheets

ELECTROMAGNETIC PATCH FOR TANK REPAIR

BACKGROUND OF INVENTION

1. Field of Invention

This invention relates to devices to repair temporarily leaks in tanks. More specifically, this invention relates to an electromagnetic patch for use in the temporary repair of small leaks in tanks, particularly railroad car tanks.

2. Prior Art

Tanks containing chemical fluids sometime develop leaks caused by corrosion within the tank, the action of a corrosive chemical within the tank or as a result of an accident. Tanks used with railroad cars are sometimes used to transport chemicals which may be corrosive or even dangerous. On occasion as a result of accidents or merely as a result of corrosion, leaks develop within these tanks. These leaks may merely be a minor problem if the fluid within the tank is non-corrosive and not dangerous. However, on occasion the chemicals contained within these tanks are highly corrosive and/or highly dangerous.

The usual procedure for the repair of such tanks is to weld a new plate over the leak. However, this procedure requires the use of welding equipment which may be not only dangerous but impractical because of where the leak develops in the tank. In addition, significant delays may occur because of an inability to staunch the flow of chemicals contained within the tank.

Normally when a leak occurs, the repair first requires the emptying of the tank, followed by its permanent repair. While the tank is being emptied, the chemical may, and often does, continue to leak unless some seal is placed over the leak. In addition, sometimes drainage of the tank is delayed because of the location of the leak in the tank or the location of the tank itself. One method sometimes used temporarily to prevent leakage from a tank is to place a patch over the leak and apply bands around the tank to hold the patch firmly in place against the leak. This method is awkward, particularly where the tank situated in an inaccessible location. Furthermore, it is difficult for a serviceman to place a band around the tank and clamp it in place while holding the patch in the precise location necessary to prevent further leakage. Further, this procedure exposes the holder of the patch to the contents of the chemical spill.

Temporary seals for chemical leaks which use a magnet as an element of the seal have been disclosed, for example, in U.S. Pat. No. 2,727,650. In that device a block comprised of a synthetic rubber, such as neoprene, is placed against a leak. The resilient block is cemented to a bar magnet. Blocks of steel are also secured to the bar magnet on either side of the resilient block. The magnetism of the magnet transfers through those steel blocks to hold the patch in place against the A similar magnetic tank repair device is disclosed in U.S. Pat. No. 3,251,461. This device is comprised of a bar magnet or magnets which are attached to a patch which can be formed into a shape to fit onto a tank. Generally the patch is a non-magnetic material which may be compressible or rubber-like. This patent attempts to solve the same problems disclosed in U.S. Pat. No. 2,727,650 . To solve these problems it relies on a bar magnet placed close to the surface of the tank to hold a patch in place.

While both of these patents disclose devices which may be useful in certain circumstances, there are certain problems which are not solved by these patents. Bar magnets, if large enough to provide sufficient holding power, are frequently awkward to handle. If not of sufficient holding power, they may not be adequate to place the required pressure upon the leak to prevent discharge of the chemical from a tank. Because of their inherent bulkiness, it is sometimes difficult to place these devices on the tank at a precise location. In addition, once in place, they may be difficult to remove to reposition. Finally, there is no mechanism to modulate the pressure on the patch itself to increase its sealing capacity.

Therefore, it is an object of this invention to provide an electromagnetic device for the temporary patching of tanks.

It is a further object of this invention to provide a new and useful electromagnetic patch for tanks and tank cars which is adaptable for use with various sizes and shapes of tanks.

It is a still further object of this invention to provide a temporary patch for tanks wherein differing pressures may be placed on the patch portion of the invention to assure stoppage of the leak.

These and other objects and features of the present invention will become apparent to those skilled in the art from a consideration of the following detailed description, drawings and claims. The description, along with the accompanying drawings, provides a selected example of the construction of the device to illustrate the invention.

SUMMARY OF INVENTION

In accordance with the present invention there is provided a temporary magnetic patch for tanks or tank cars comprised of a housing, electromagnets secured to the housing, a patch for closing the leak and a pressure system to which is attached the patch which system is attached to the housing for pressing the patch firmly in place against the side of the tank to prevent the leaking of liquid material within the tank.

BRIEF DESCRIPTION OF THE DRAWINGS

This invention will now be described with reference to the accompanying drawings in which.

DETAILED DESCRIPTION OF THE PREFERRED EMBODIMENT

Figure 1:
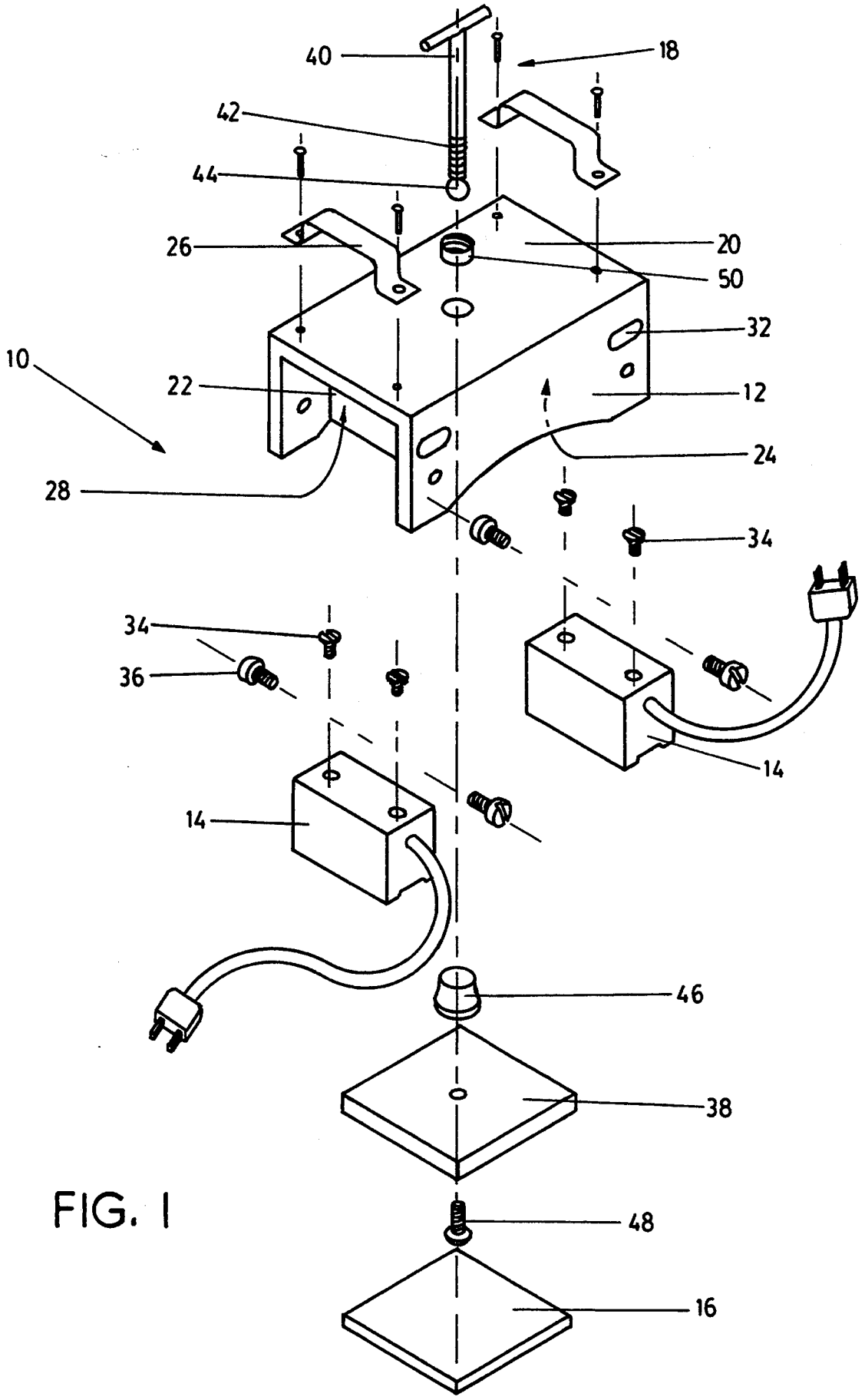
FIG. 1 is an exploded view of a preferred embodiment of the temporary magnetic patch.

Although the invention is adaptable to a wide variety of uses, it is shown in the drawings for purpose of illustration as embodied in a temporary electromagnetic patch designed specifically for use with chemical tanks or tank cars. It is well within the confines of the invention to use this temporary electromagnetic patch on any steel-based container to prevent the leakage of a liquid or a gas from within that container. However, this device is specifically designed for the temporary patching of chemical tanks or tank cars.

Figure 2:
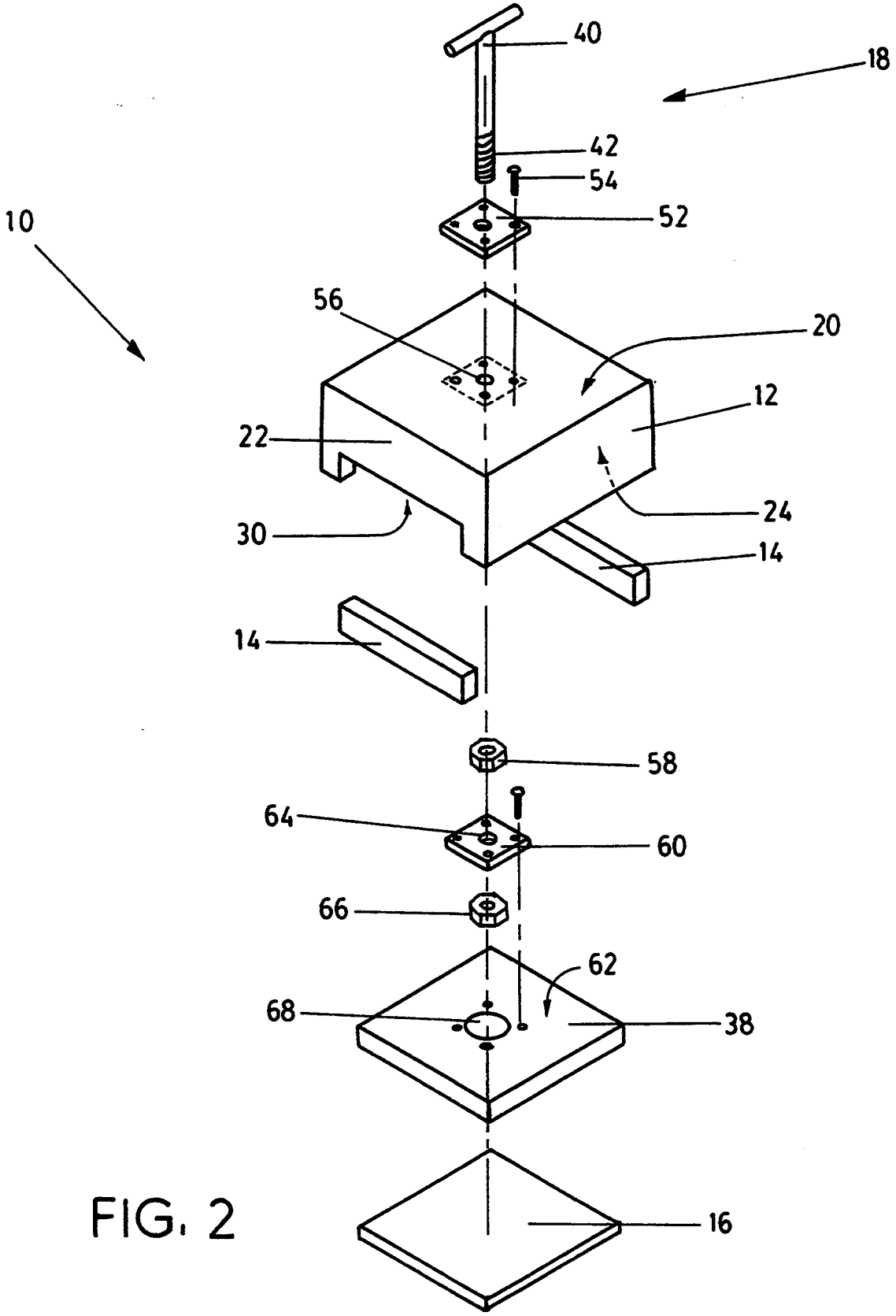
FIG. 2 is an exploded view of an alternative embodiment of the temporary magnetic patch.

The temporary electromagnet patch (10) is shown in the drawings for purpose of illustration as embodied in a housing (12), at least a pair of electromagnets (14), a seal (16) and a pressure system (18) for pressing the seal (16) against the surface of a tank or tank car. See FIGS. 1 and 2.

The housing (12) can be any size or shape depending upon the shape of the seal being used. In one preferred embodiment the housing is a generally square or rectangular in cross-section with a top flat surface (20) and with four walls (22) extending downward from the top surface (20) to create an opening section (24) on the bottom portion of the housing (12). In a preferred embodiment, two of the opposite walls are recessed from the ends of the top surface (20) leaving an inset portion (28) into which each of the electromagnets (14) is secured. See FIG. 1. In an alternative embodiment at least two of the walls (22) which extend downward contain cut-out sections (30) into which the electromagnets (14) are secured.

The housing (12) is constructed of any light weight, strong material, preferably non-metallic, such as a heavy duty plastic. The housing should be resistant to chemicals as it is used for the patching of tanks which may spill acids or corrosive organic materials. The top surface (20) of the housing is generally flat. Handles (26) may be secured to the housing (12) for easier movement of the device. In the preferred embodiment, at least two of the walls (22) extending downward from the top surface have openings (32) of sufficient size to accommodate the cables used to convey the electricity to the electromagnets. Inside the four walls of the housing is the opening section (24). The seal (16) as well as a lower portion of the pressure system (18) may be withdrawn into the opening section (24) of the housing when it is not extended from the housing (12).

The electromagnets (14) which are secured to the sides (22) of the housing (12) and are an integral portion of the invention can be any conventional electromagnets. Preferably they are of a bar-like construction and can be of a size anywhere from 4 to 15 inches in length or even longer, depending upon the size of the seal used. The strength of the electromagnets will depend upon the needs of the ultimate user. In one preferred embodiment the power of each electromagnet is approximately 500 pounds of holding power. The holding power of the electromagnet can be modified to provide lesser or a greater holding power, depending upon the needs of the user. The preferred electromagnets should operate off of a conventional battery source, such as a 12-volt battery. Thus, this temporary electromagnetic patch is highly portable. By using an electromagnet, as opposed to a permanent magnet, a significant improvement occurs over prior art magnetic seal products. The seal of such a temporary electromagnetic patch may be placed in a precise location on the tank prior to the engagement of the electromagnet. Once turned on, the electromagnet will securely hold the seal in that location until the electricity is turned off. Because of the portability of the electromagnets, these seals have utility virtually at any location. Although two electromagnets are contemplated, clearly more, or less, electromagnets can be used depending upon the needs of the ultimate user and the size of the seal.

The electromagnets (14) are secured within the inset portion (28) of the sides of the housing (12) in the preferred embodiment or within the cut out section (30) of the housing (12) in the alternative preferred embodiment by any conventional means. In the preferred embodiment, the electromagnets are held in place by screws (34) extending through the top surface (20) of the housing (12) into the top surface of the electromagnet. One or more and, preferably, two such screws are used. In addition, additional screws (36) may be inserted through the sides of the housing and into the electromagnet (14) to provide additional support for the electromagnets. In the alternative preferred embodiment the electromagnets are held in place by pins extending from the ends of the bar of the electromagnet, wherein such pins extend into openings in the sides of the cut-out section (30) of the sides.

The type of seal (16) used and its ultimate shape will depend upon the needs of the ultimate user. In a preferred embodiment, the seal (16) is a deformable plastic material, which can be molded to the shape of the tank or tank car which is being repaired. For example, the seal (16) can be a neoprene rubber-like product, or other such plastic material, which is generally resistant to chemicals. The composition of the seal can be modified by the user based on the material being stored in the tank. In addition, the seal (16) may be formed in various shapes to fit the size and shape of the tank or tank car which is being repaired. Thus, the bottom surface of the seal (16) can be convex in shape to mimic the shape of the tank. The overall size, shape and length of the seal (16) can vary depending upon the needs of the ultimate user and can be modified to the needs of the particular job. For example, the seal (16) can be rectangular in shape and approximately 4 inches in length by approximately 10 inches in width. In an alternative embodiment, the seal is more square in shape and approximately 10×10 inches or even larger. The size of the seal (16) is generally only limited by the size of the job for which the seal is being used. It is understood that the larger the seal, the larger the overall temporary electromagnetic patch (10) and the bulkier the device.

The pressure system (18) permits extension pressure to be placed upon the seal (16) to force it firmly and securely against the side of the tank or tank car to stop the leak. The pressure system (18) is comprised of the base plate (38) which is secured to the seal (16), a system for forcing the base plate (38) outward from the housing (12) and elements for securing both the base plate (38) and the system for forcing the base plate outward, to the housing.

Many alternative embodiments can be used for this pressure system. However, in a preferred embodiment the pressure system (18) contains a t-shaped handle (40) containing a threaded portion (42). The t-shaped handle (40) communicates directly with the base plate (38) and when the t-shaped handle (40) is rotated in a clock-wise manner, the base plate (38) extends away from the housing (12) thus forcing the seal (16) away from the housing (12). The t-shaped handle (40) communicates with the base plate (38) by any conventional means. In one preferred embodiment, the t-shaped handle communicates with and operates in conjunction with the base plate (38) by means of a ball bearing tip (44) attached to the end of the threaded portion of the t-shaped handle (40) which operates in conjunction with a ball bearing cup (46). See FIG. 1. The ball bearing cup (46) is secured to the ball bearing tip (44) by a conventional ball bearing arrangement and is held in place by the pressure exerted by the pressure system (18). This interrelationship between the ball bearing tip (44) and the ball bearing cup (46) permit the circumferential rotation of the t-shaped handle (40) without moving the base plate (38) and the seal (16) when the seal (16) is placed against the tank. The base plate (38) is secured to the ball bearing cup (46) by any conventional means such as a screw (48) projecting upward from below the base plate (38) through the base plate (38) into the bottom of the ball bearing cup (46). The t-shaped handle (40) is extended from the housing (12) by being threaded through a threaded guide (50) which is an integral part of the top surface (20) of the housing (12). The threaded guide (50) extends through the top surface (20) permitting the threaded portion (42) of the t-shaped handle to rotate and be extended through the threaded guide (50) to act in concert with the ball bearing cup (46).

In an alternative embodiment, the t-shaped handle (40) communicates with the base plate (38) by use of an arrangement of threaded plates, stop plates and nuts. See FIG. 2. Specifically, a threaded plate (52) is secured to the top surface (20) of the housing (12) by conventional means such as screws (54) or epoxy adhesives. An opening (56) is provided through the top surface (20) of the housing (12) through which the threaded portion (42) of the t-shaped handle (40) extends. As the t-shaped handle (40) is turned and extended through the threaded plate (52) which is secured to the housing (12), it also rotates a first stop nut (58) which is secured to the threaded portion (42) of the t-shaped handle (40). A stop plate (60) is secured to the top surface (62) of the base plate (38) in such a manner as to permit the threaded portion (42) of the t-shaped handle (40) below the first stop nut (58) to rotate through a central opening (64) in the stop plate (60). To prevent the base plate (38) from being completely removed from the pressure system (18), a second stop nut (66) is secured to the bottom of the threaded portion (42) of the t-shaped handle (40) into an opening (68) placed in the base plate (38) itself.

Each of the elements of the pressure system (18) and the t-shaped handle (40) should be produced from high quality, corrosion-resistant steel or other materials with such characteristics. It is understood that these elements of the device may be exposed to the leaks from the tank car and thus, corrosion resistance is of primary importance.

In operation, the invention functions in the following manner. Once a leak is discovered in a tank or tank car, an appropriate seal (16) is chosen which is of an appropriate size, shape and composition to prevent the deterioration of the seal when in contact with the leaking chemical. The seal (16) is secured to the base plate (38) by conventional means such as an epoxy adhesive of sufficient holding ability to hold it securely in place to the base plate. The base plate (38) is then secured within the pressure system (18). The base plate (38) is withdrawn fully into the opening section (24) of the housing (12) of the temporary electromagnetic patch (10). Appropriate size and strength electromagnets (14) are chosen and wiring for those electromagnets are put in place. Obviously, a source of electricity must be convenient so that appropriate electricity will be available for the electromagnets. As these electromagnets can operate off of any 12-volt battery, the electromagnets are highly portable. The temporary magnetic patch (10) is then transported to the tank or chemical storage facility and placed against the tank so that the seal (16) is directly in contact with the leak. Electricity to the electromagnets is then turned on, thus securing the housing in place against the tank.

The t-shaped handle (40) of the pressure system (18) is then rotated in a clockwise manner. In a first preferred embodiment, as the t-shaped handle (40) rotates through the threaded guide (50) of the top surface of the housing, it extends the base plate (38) away from the housing (12). This also compresses the seal (16) firmly against the tank. By increasing the pressure of the t-shaped handle (40) by clockwise rotation, the pressure of the seal (16) against the surface of that tank is also increased.

In an alternative preferred embodiment, as the t-shaped handle (40) rotates through the threaded plate (52) secured to the top surface (20) of the housing (12). The first stop nut (58) presses against the stop plate (60) which has been secured to the top surface of the base plate (38) thus forcing the seal (16) outward from the housing (12). The t-shaped handle (40) continues to be rotated until sufficient pressure is placed on the seal (16) against the tank or tank car. Once sufficient pressure is placed on the seal (16) to secure it firmly against the tank such that the leak has been stopped, no further rotation is necessary of the t-shaped handle (40).

The tank car can then be safely drained, removing the chemical from the tank. Once the tank has been drained and the temporary electromagnetic patch (10) is no longer necessary, the t-shaped handle (40) can be rotated in a counter clockwise direction to reduce the pressure on the seal (16) against the tank or tank car. In the second preferred embodiment, the second stop nut (66) prevents the base plate (38) from being disengaged from the pressure system (18) of the temporary electromagnetic patch (10). At the same time the electricity to the electromagnets can be removed, thus permitting the temporary magnetic patch to be removed from the tank or tank car. At this time, the tank car can be permanently repaired by conventional repair procedures.

I claim:

1. A temporary electromagnetic patch comprised of
(a) a housing with a generally flat top surface, wherein the housing is generally rectangular in cross section with an open bottom with four walls extending downward from the top surface of the housing to form an open section therein and wherein two of the walls which are opposite each other are perpendicular to the remaining two walls to form a box-like structure with an open bottom;
(b) a pair of electromagnetics secured to two opposite walls of the housing;
(c) an extending pressure system attached to the housing, a portion of which extends through the top surface of the housing;
(d) a base plate secured to the extending pressure system such that the extending pressure system can both withdraw the base plate within the opening section of the housing and also extend the base plate away from the housing; and
(e) a seal secured to the bottom surface of the base plate.

2. The temporary electromagnetic patch of claim 1 wherein a portion of a bottom surface of each of the two walls not containing the pair of electromagnets extend downward from the top surface of the housing.

3. The temporary electromagnetic patch of claim 1 wherein the pressure system is comprised of a threaded, t-shaped handle, a threaded guide secured to the housing through which the t-shaped handle can be threaded, a ball bearing secured to the tip of the t-shaped handle, and a ball bearing cup secured to the base plate.

4. The temporary electromagnetic patch of claim 1 wherein the electromagnets are secured to the housing by a screw means secured through the top surface of the housing and through at least two of the sides of the housing into the electromagnets.

5. The temporary electromagnetic patch of claim 1 wherein the electromagnets are secured to the housing within cut-out portions on two of the walls of the housing and wherein pins extend from the ends of each electromagnet into openings in the walls of the housing.

6. The temporary electromagnetic patch of claim 1 wherein a surface of the seal is convex in shape.

7. The temporary electromagnetic patch of claim 1 wherein the electromagnet has a holding power of at least about 500 pounds.

8. The temporary electromagnetic patch of claim 1 wherein the electromagnets are powered from a battery.

9. The temporary electromagnetic patch of claim 1 wherein the pressure system is comprised of a threaded, t-shaped handle, a threaded plate secured to the top surface of the housing through which the t-shaped handle can be threaded, a stop plate secured to the base plate and a means for extending the base plate away from the housing upon rotation of the t-shaped handle.

10. The temporary electromagnetic patch of claim 9 wherein the means for extending the base plate away from the surface of the housing upon rotation of the t-shaped handle is a stop nut secured to the threaded surface of the t-shaped handle which presses against the stop plate upon rotation of the t-shaped handle.

* * * * *